US008100348B2

(12) United States Patent
Wissink et al.

(10) Patent No.: US 8,100,348 B2
(45) Date of Patent: Jan. 24, 2012

(54) DEVICE FOR GENERATING MICROSPHERES FROM A FLUID, METHOD OF INJECTING AT LEAST ONE FIRST FLUID INTO A SECOND FLUID, AND AN INJECTION PLATE

(75) Inventors: Jeroen Wissink, Enschede (NL); Cornelis Johannes Maria Van Rijn, Hengelo (NL); Wietze Nijdam, Zutphen (NL); Christiaan Haldir Goeting, Amsterdam (NL); Iwan Rutger Heskamp, Enschede (NL); Gerrit Jan Veldhuis, Hengelo (NL)

(73) Assignee: Nanomi B.V., Hengelo (O) (NL)

( * ) Notice: Subject to any disclaimer, the term of this patent is extended or adjusted under 35 U.S.C. 154(b) by 1282 days.

(21) Appl. No.: 11/597,504

(22) PCT Filed: May 25, 2005

(86) PCT No.: PCT/NL2005/000385

§ 371 (c)(1),
(2), (4) Date: Jan. 24, 2007

(87) PCT Pub. No.: WO2005/115599

PCT Pub. Date: Dec. 8, 2005

(65) Prior Publication Data

US 2007/0227591 A1 Oct. 4, 2007

(30) Foreign Application Priority Data

May 25, 2004 (NL) ..... 1026261

(51) Int. Cl.
*A62C 5/02* (2006.01)

(52) U.S. Cl. ..... 239/310; 239/590.3

(58) Field of Classification Search ..... 239/310, 239/311, 339, 366, 368, 369, 372, 398, 422, 239/432, 590, 590.3
See application file for complete search history.

(56) References Cited

U.S. PATENT DOCUMENTS 4,132,634 A * 1/1979 Rumpf et al. ..... 209/136
(Continued)

FOREIGN PATENT DOCUMENTS

EP 01197262 B1 4/2002
(Continued)

OTHER PUBLICATIONS

Database WPI Section Ch, Week 198740 Derwent Publications Ltd. London, GB, Class H06, AN 1987-283485 Golitsynkij Boris P 'SU!; Korshunov Oleg m 'SU!: "Water-fuel emulsion prepn.—consists of injection of liq. fuel at above critical rate and super heated water at reduced pressure".

*Primary Examiner* — Davis Hwu
(74) *Attorney, Agent, or Firm* — Young & Thompson

(57) ABSTRACT

A device for generating microspheres from a fluid includes an injection plate with at least one defined injection channel having on an inlet side an inflow opening for receiving the fluid and on an outlet side an outflow opening for delivering microspheres formed from the fluid. The device includes feed elements for carrying fluid through the injection channel and is in open communication, on a side wall thereof, with at least one secondary channel at least at the position of a break-up point where at least during operation a flow of fluid in the injection channel breaks up into separate parts. The secondary channel includes in use an auxiliary fluid at least at the position of a break-up point.

20 Claims, 11 Drawing Sheets

U.S. PATENT DOCUMENTS

| | | | | | |
|---|---|---|---|---|---|
| 4,153,541 | A | * | 5/1979 | Rumpf et al. | 209/143 |
| 4,551,240 | A | * | 11/1985 | Beppu et al. | 209/143 |
| 4,657,667 | A | * | 4/1987 | Etkin | 209/135 |
| 4,802,977 | A | * | 2/1989 | Kanda et al. | 209/143 |
| 5,476,744 | A | | 12/1995 | Anno et al. | |

FOREIGN PATENT DOCUMENTS

| | | |
|---|---|---|
| SU | 1 296 205 | 3/1987 |
| WO | 2004/002627 | 1/2004 |

* cited by examiner

DEVICE FOR GENERATING MICROSPHERES FROM A FLUID, METHOD OF INJECTING AT LEAST ONE FIRST FLUID INTO A SECOND FLUID, AND AN INJECTION PLATE

FIELD OF THE INVENTION

The present invention relates to a device for generating microspheres from a fluid, comprising an injection plate which comprises at least one defined injection channel having on an inlet side an inflow opening for receiving the fluid and on an outlet side an outflow opening for delivering microspheres formed from the fluid, and provided with feed means for carrying the fluid through the injection channel. The invention also relates to a method for injecting at least one first fluid into a second fluid, and to an injection plate. The invention relates particularly here to the generating of microspheres from an injection channel with an effective diameter of between 0.1 and 50 micrometers, for the purpose of injecting small liquid microdroplets into a liquid in order to obtain an emulsion, or gas microbubbles into a liquid in order to obtain a foam. It is noted here that where for the sake of brevity droplets or microdroplets are mentioned hereinbelow, unless the opposite is clearly apparent from the context, this is also understood to mean bubbles or microbubbles.

BACKGROUND OF THE INVENTION

A known method for making an emulsion (or foam) is so-called cross-flow emulsification, wherein a fluid for dispersing is forced as dispersed phase through an injection plate with injection channels, while a continuous cross-flow phase of a second fluid is guided at a certain speed, transversely of the outflow openings of the injection channels, over the outlet side of the injection plate. An example of such a known method and associated device is described in European patent application EP 1.197.262. The second fluid flowing past here exerts a shear stress on the first fluid leaving the injection plate, whereby upon reaching a certain size a microdroplet is separated from the first fluid and entrained and absorbed in the second fluid. The size of the thus formed microdroplets is determined partly by the speed of the second fluid that is flowing past and the nature of both fluids. Microdroplets are thus formed with a varying diameter of typically between 2 and 20 times the effective diameter of the injection channel in the injection plate. It is noted here that where mention is made in the present application of an effective radius or diameter of a channel, this is understood to mean the radius or diameter of an imaginary, perfectly round reference channel of a size such that an equal inflow resistance to the relevant fluid is encountered. In order to enhance shearing of microdroplets by the second fluid, use is made in the known device of injection channels with a non-round and non-square cross-section in order to thus create an unstable boundary surface between the dispersed phase of the first medium and the continuous phase of the second medium at the outflow opening of the injection channel.

It is found desirable for an increasing number of applications that the microdroplets formed with the device are very fine and moreover have a mutually almost equal size. These are for instance microdroplets with a diameter of typically one tenth of a micrometer and several tens of micrometers which are all at least practically of equal size. Such very small, almost mono-dispersed microdroplets result in for instance a great improvement in the stability of an emulsion (oil/water, water/oil). The texture and rheology of many foams also improves if very small and equal gas microbubbles are incorporated in this foam. This latter is found to be particularly important in the dairy industry, wherein light products are in increasingly great demand and optionally multiple emulsions open avenues to new products and product groups.

The known device and method have the drawback that the droplet size depends on more or less chance process parameters and is thereby not fixed but, on the contrary, varies relatively widely within the given limits. In the known device and method for forming the microdroplets a cross-flow of a second fluid on the outlet side of the injection plate is moreover essential. Realizing such a cross-flow of the second fluid is sometimes found to be time-consuming in practice.

SUMMARY OF THE INVENTION

The present invention therefore has for its object, among others, to provide a device of the type stated in the preamble wherein a cross-flow of a second fluid is not necessary. It is a further object of the invention to provide a device and method of the type stated in the preamble with which very fine microdroplets of an at least almost constant mutual size can be formed.

In order to achieve the intended objective a device of the type stated in the preamble has the feature that the injection channel is in open communication, on a side wall thereof, with at least one secondary channel at least at the position of a break-up point where at least during operation a flow of the fluid in the injection channel breaks up into separate parts, that the secondary channel is intended and adapted at least during operation to comprise an auxiliary fluid at least at the position of the break-up point, and that for at least a part of the fluid an inflow resistance of the secondary channel is greater than an inflow resistance of the injection channel. The auxiliary fluid which thus enters into contact with the injection flow of the first fluid on the side wall of the injection channel already facilitates a separation in the injection channel at the break-up point of a droplet from the remaining part of the injection flow. This process, also referred to as self-break-up or auto-break-up so as to distinguish it from break-up effected by a cross-flow of the second fluid as in the known device and method, makes it possible to break up the first fluid in precisely defined, mono-dispersed microdroplets without being dependent in any way on effects and factors from 'outside' the injection channel, such as for instance an applied cross-flow. This mechanism moreover still results in droplet formation even without cross-flow on the outlet side of the injection plate. The device according to the invention can hereby be applied for both cross-flow emulsification and for direct droplet formation.

The invention is based here on the insight that the droplet separation is better controlled and is accelerated by thus having the break-up of the liquid flow take place not at the boundary surface of the injection plate and the second fluid but, instead, already in the injection channel itself. The location of the break-up point is determined by a combined action of surface tensions of the first and the auxiliary fluid and the local geometry of the injection channel, and is precisely fixed thereby. The location of the droplet separation, and therefore the droplet size, does not therefore depend particularly on dynamic environmental factors and process parameters such as define the droplet size in the known device and method and which are difficult to control, or cannot be controlled. The lower the flow resistance to the auxiliary fluid toward the injection channel, the easier and more rapidly the break-up of the first fluid into droplets will progress. For a greater droplet capacity a number of secondary channels are therefore preferably applied, and a flow resistance therein is preferably kept as low as possible.

The inflow resistances of respectively the injection channel and the secondary channel are characterized by their effective diameter ($d_{eff}$) which is defined by the corresponding bubble-point Laplace pressure ($P_{Laplace}$) for the first fluid in accordance with $d_{eff}=4.\gamma/P_{Laplace}$. Use is made here of non-wetting conditions for the first fluid. At the moment the non-wetting condition is not fully reached, the boundary surface tension ($\gamma$) must be multiplied by the cosine of the resulting contact angle between injection plate, first fluid and auxiliary fluid, as is standard according to Young's formula. The effective radius is defined by half the effective diameter.

Self-break-up is a dynamic process wherein the surface of a determined quantity of first fluid in the injection channel becomes unstable due to disruptions and surface waves of a wavelength of about the effective circumference of the injection channel can grow. In the case of a round injection channel this is a wave with a wavelength equal to $2\pi$ times the radius of the injection channel. The waves have a form wherein a neck grows from the first fluid in the injection channel and outside thereof a droplet which becomes increasingly thicker. The driving force is the surface tension which, if the auxiliary fluid can reach the break-up point, ensures that the first fluid always breaks up into droplets there so as to minimize the potential energy of the system. Effects and influences from outside the injection channel, such as a possible cross-flow and viscosity of a second fluid, are not a factor here.

The formation and separation of microspheres always having substantially the same size as a result of self-break-up occurs irrespective of whether a cross-flow of a second fluid is present on an outlet side. The device according to the invention can thereby be operated and applied without such a cross-flow. A particular embodiment of the device according to the invention nevertheless has the feature that the injection plate and the inlet side bound a first space, which first space is intended and adapted to receive therein at least one first fluid at least during operation, and that the injection plate and the outlet side bound a second space, which second space is intended and adapted to receive therein at least one second fluid at least during operation. The formed microspheres are herein injected directly into the second fluid so as to thus form for instance a mono-dispersed foam or mono-dispersed emulsion. Such precisely defined foams and emulsions are of great importance for numerous applications from both a process engineering and commercial viewpoint.

The feed of the auxiliary fluid to the break-up point can be realized per se in diverse ways. The auxiliary fluid can thus be supplied separately or, on an outlet side of the injection channel, be drawn from the second fluid, in particular for instance from a cross-flow thereof. Other than with a separate feed, in this latter case the auxiliary fluid will then always be the same as the second fluid of the cross-flow. This is nevertheless found to be very practical because in this case a separate flow does not have to be arranged for the auxiliary fluid. With a view to the feed of the auxiliary fluid, a particular embodiment of the device according to the invention has the feature that the secondary channel extends, at least during operation, in open communication from a surface of the injection plate, in particular from the outlet side thereof. The secondary channel is herein supplied from the surface of the injection plate, in particular from the outlet side, from a cross-flow of a second fluid that is flowing past.

In a particular embodiment, the device according to the invention has the feature that the secondary channel is a laterally bounded side extension of the injection channel which extends from the outlet side of the injection plate to at least the break-up point of the injection channel. Such a side extension can be defined in the same, or at least similar, process as the injection channel itself and from the outlet side allows fluid, for instance from a cross-flow flowing at that position, as far as the break-up point with a very low flow resistance. Such an extension is herein defined and proportioned according to the invention such that an inflow resistance thereof to the first fluid is greater than an inflow resistance of the injection channel. With a careful choice of the fluid pressure, a fluid flow of the first fluid through the injection channel can thus be applied during operation wherein the first fluid remains enclosed in a central part of the injection channel without entering such an extension, which is filled on the contrary with the auxiliary fluid. In a particular embodiment, such a side extension herein has an incomplete, at least substantially round or polygonal cross-section transversely of a flow direction of the injection channel.

In a preferred embodiment, the device according to the invention has the feature that the injection channel has a number of laterally bounded side extensions which extend from the outflow opening to at least the break-up point, and that neighbouring extensions are immediately adjacent of each other and herein mutually enclose a pointed wall part of the injection channel. The pointed, sharp wall parts between successive extensions reduce the contact surface for the forming droplet, and this enhances and accelerates a final break-off of the droplet. In this manner it is possible to realize an at least practically mono-dispersed break-up, wherein a cross-flow of any significance does not have to be applied, or hardly so, on the outlet side, and a sufficiently powerful droplet delivery is nevertheless achieved. Such pointed wall parts also prevent penetration of the first fluid into the secondary channel at the contact surface with the injection channel.

Instead of via one or more well-defined secondary channels, the auxiliary fluid can also be carried to the break-up point via a secondary channel in the form of a porous network of mutually communicating pores, referred to below simply as an open pore structure. A further preferred embodiment of the device according to the invention has for this purpose the feature that, at least at the position of the break-up point, a wall of the injection channel is porous with an open pore structure, which open pore structure forms the at least one secondary channel, and more particularly that the injection plate comprises at least a top layer with an open pore structure from the outlet side at least as far as the break-up point in the injection channel, which open pore structure forms the at least one secondary channel. Such a structure as secondary channel has the advantage that no further lithographic or other manufacturing steps are required for this purpose. Once the injection channel is formed, the feed of the auxiliary fluid is possible via the porous structure. So as to preclude as far as possible mutual influencing of injection channels possibly accommodated together in the injection plate, a further particular embodiment of the device according to the invention has the feature that the injection plate comprises a number of individual injection channels, particularly for the auxiliary fluid, which are accommodated in separated parts of the top layer of the injection plate. The individual injection channels thus have their own porous structure for the feed of auxiliary fluid to the break-up point.

A droplet delivery is also enhanced in a further particular embodiment of the device according to the invention which is characterized in that the injection plate comprises a projection on the outlet side around the outflow opening of the injection channel. The injection channel herein protrudes with the projection as if it were a 'chimney' above an adjoining part of the surface of the injection plate, which enhances break-off and delivery of a droplet forming thereon. Such an outer end moreover has the advantage that the first fluid can less easily contaminate the surface of the injection plate, whereby the operation of the device is more precise.

In a further particular embodiment, the device according to the invention is herein characterized in that the projection of the injection plate at least partially comprises the at least one secondary channel. In a preferred embodiment, the device according to the invention is herein characterized in that the at least one secondary channel comprises at least one perforation or slot in a wall of the projection. The formation of the secondary channel in the normally relatively thin wall of the projection results in an exceptionally low flow resistance of the second fluid as auxiliary fluid, whereby high flow speeds of the first fluid are feasible without adversely affecting the desired self-break-up thereof. Very good results have been achieved in this respect with injection channels having a substantially polygonal, in particular star-shaped cross-section. The at least one secondary channel can be formed specifically as perforation or slot in the projection. In a further preferred embodiment of the device according to the invention, the projection is however porous in order to realize the supply of an auxiliary fluid via an open pore structure thereof. A particular embodiment hereof comprises a bundle of porous hollow tubes, capillaries or fibres, preferably a shortened capillary membrane filter.

The invention provides a device which produces droplets or bubbles, wherein the use of a cross-flow is not necessary, whereby an almost mono-dispersed droplet distribution can be obtained. The invention is here based on a self-break-up of a fluid in an injection channel of the injection plate. Exceptionally good results can be achieved in this respect with a particular embodiment of the device according to the invention characterized in that the injection channel has a length which amounts to a minimum of about twice a distance between the outflow opening and the break-up point. By making use of such a minimum length in respect of the injection channel, the break-up mechanism is not disrupted, or hardly so, by the inflow of the fluid into the injection channel. More particularly the injection channel is preferably dimensioned and designed such that the break-up point lies at a distance removed from the outflow opening of one to five times, in particular two to four times and more particularly about $\pi$ times an effective radius of the injection channel.

In the device according to the invention transport of a fluid for dispersion takes place via the injection channel, while the secondary channel provides an inflow of an auxiliary fluid to the break-up point in the injection channel, whereby the fluid for dispersion will break up at that position. It is important here that the inflow of the auxiliary fluid in the secondary channel is not obstructed too much by the generation of dispersed microdroplets on the outlet side of the injection channel. In order to maximize the speed, and thereby the flux, of the injection plate, a further particular embodiment of the device according to the invention has the feature that at least one secondary channel per injection channel is chosen in number and area such that up to the break-up point in respect of the auxiliary fluid a total flow resistance of the secondary channel is smaller than ten times a flow resistance of the injection channel from the break-up point in respect of the first fluid.

In order to prevent displacement of the auxiliary fluid from the at least one secondary channel by the first fluid, a further particular embodiment of the device according to the invention has the feature that an effective diameter of the secondary channel is smaller than an effective diameter of the injection channel, preferably a minimum of twice as small. An injection plate wherein the effective diameter of the secondary channel is two to five times smaller than the effective diameter of the injection channel has the advantage that, even at (transmembrane) pressures which are much greater than the Laplace pressure of the injection channel, the first fluid cannot penetrate into the secondary channel, or hardly so.

A further particular embodiment of the device according to the invention is characterized in that the injection channel, optionally in combination with the injection plate, has a nano-rough or micro-rough surface structure. Covering the injection channel, optionally in combination with the injection plate, with a coating having a nano-rough or micro-rough structure prevents wetting by the first fluid. Because a lotus effect is hereby realized, a contact line between first fluid and injection channel wall is broken. Contamination of the injection plate surface by the first fluid and penetration of the first fluid into the secondary structures will hereby be prevented. This prevents contamination and thereby increases the period of reliable operation. Such a coating can consist of carbon, carbon-like compounds, metals, ceramic materials, metal oxides, polymers, SAMs (self-assembling monolayer), or combinations of these materials.

The system of injection plate, auxiliary fluid and first fluid is preferably adjusted such that the auxiliary fluid can in any case wet the injection plate better than the first fluid. In the ideal case the auxiliary fluid can wet the injection plate fully and the first fluid cannot wet the injection plate at all (non-wetting). In order to facilitate this in practice, substances can be added to the first and/or auxiliary fluid which decrease the angle of contact between the auxiliary fluid and the injection plate, such as specific surfactants or proteins in the case of liquid. This can be further achieved by covering the injection channel and/or the injection plate surface with a material which provides the desired wetting properties. The use of an emulsifier/stabilizer (for instance SDS, TWEEN etc.) in a formed emulsion can be reduced considerably by special measures which cause the droplet break-up to take place in stable manner, such as degassing a liquid fluid and forced discharge of formed droplets or bubbles. An emulsifier is not necessary at all for the process of self-break-up, while the stability of the mono-dispersed droplets formed here requires a notably smaller quantity of stabilizers than is usually applied in poly-dispersed emulsions.

A further particular embodiment of the device according to the invention has the feature that the injection plate has, at least in a wall part around the injection channel, a microporous structure with a very low flow resistance to the auxiliary fluid. Such a microporous structure facilitates penetration of the auxiliary fluid into the injection channel and can be obtained in many ways, including for instance by means of a phase-separation process as is usual in the manufacture of polymer filtration membranes. The supply of auxiliary fluid during operation can be realized by providing an external pressure in the microporous structure. The greater the part of the injection plate having such a microporous structure, the more easily this proceeds.

In a further particular embodiment, a device according to the invention has the feature that the injection channel extends substantially laterally in the injection plate, that the at least one secondary channel opens onto a free surface part of the injection plate with at least one perforation of a first dimension, and that the injection channel debouches on the outlet side of the injection plate into at least one perforation of a second, larger dimension. The injection channel is herein arranged lengthwise in the injection plate, wherein via one or more relatively small perforations in a wall of the injection channel at the position of the break-up point the first fluid in the injection channel can enter into direct contact with the auxiliary fluid provided at that position. The droplets appear from the outflow opening of the injection channel in the form of one or more larger perforations. In this embodiment a path length, and thereby a flow resistance to the auxiliary fluid to the break-up point, can be relatively small and additional freedom of design is obtained because the outflow opening does not have to lie in line with the injection channel. In addition, this embodiment provides the option of varying the injection channel along its length, which also provides extra design freedom.

In order to generate droplets from different starting substances, and double or even multiple emulsions, a particular embodiment of the device according to the invention has the feature that, at least during operation, the inflow opening of the injection channel is in open communication, optionally simultaneously, with separate inlets for different fluids.

The invention also relates to a method for injecting at least one first fluid into a second fluid using a device according to the invention, which method according to the invention is characterized in that the at least one fluid is provided to the inlet side of the injection plate at an operating pressure lying between a pressure for overcoming an inflow resistance of the injection channel and a pressure for overcoming an inflow resistance of the secondary channel, that the second fluid is carried on the outlet side along a surface of the injection plate, and that the at least one secondary channel is supplied with an auxiliary fluid. A cross-flow of the second fluid is herein applied on the outlet side of the injection plate, and the first fluid is urged into the injection channel by means of applying an overpressure relative to the second fluid which is at least higher than the required inflow Laplace pressure associated with the specific geometry of the injection channel. The difference between the pressure for overcoming a boundary surface tension between the first fluid and the second fluid in the injection channel and the overpressure applied to the first fluid is converted into kinetic energy and friction, and provides a movement of the first fluid through the injection channel in the direction of the second fluid. A boundary surface between the first and second fluid thereby moves wholly to the outflow opening of the injection channel. Once outside this, the first fluid is no longer clamped between the walls of the injection channel and the boundary surface will take on a spherical form. The (Laplace) pressure in the formed sphere falls relative to the situation in the injection channel as a consequence of a decreasing curvature of the surface of the first fluid in the now growing droplet.

During the growth of a droplet the pressure close to the outflow opening decreases further and a pressure gradient is created from the pressure in injection channel $P_n$ to the pressure of the first fluid P (trans-channel pressure). From the moment that at a distance $k.r_n$, with k roughly equal to $\pi$, from the outflow opening in the injection channel the pressure has fallen until the cylinder Laplace pressure becomes $P_n=\gamma/r_n$, the column of the first fluid is unstable over this distance, and a surface wave will initiate a break-up in a manner comparable to the Rayleigh break-up known from the literature, facilitated here by the auxiliary fluid provided at that position from the at least one secondary channel. Break-up of the flow of the first fluid will thus occur always at the same location and with a great regularity, which results in a delivery of droplets having at least practically the same size as each other. Use is made here of a perfectly round, cylindrical injection channel with a radius $r_n$, although differently formed injection channels behave in wholly corresponding manner, albeit that a correction factor must be taken into account here, wherein k will have a value between 1 and 5. If the wetting/non-wetting condition is not fully achieved, the boundary surface tension ($\gamma$) must be modified as is standard according to Young's formula.

A particular embodiment of the method herein has the feature according to the invention that the second fluid is introduced as auxiliary fluid in the at least one secondary channel. An auxiliary fluid is not supplied separately in this case, but is drawn for this purpose from (the flow of) the second fluid.

A further particular embodiment of the method according to the invention has the feature that the auxiliary fluid is supplied together with the first fluid at least partially via the injection channel. Likewise dispensed with therefore is a separate supply of an auxiliary fluid which is here pre-mixed with the first fluid or is dispersed therein (pre-emulsion) to be admitted simultaneously into the injection channel. In the injection channel the auxiliary fluid then separates and forms at the break-up point a separate phase which facilitates break-up of the first fluid at that position. In addition to single emulsions, double and multiple emulsions can thus also be manufactured and emulsion can be modified. Such a modification of an existing emulsion can for instance be a homogenization, wherein a first phase of an emulsion is processed into mono-dispersed droplets with the method according to the invention, and thus delivered on the outlet side. A second phase of the emulsion herein functions as auxiliary fluid which is provided in mixed form. Secondary channels in the injection plate in this case open on an inlet side of the substrate, for instance as lateral extensions of the injection channels or as micro-channels in a porous substrate structure. In the latter case it is recommended to cover the substrate on the outlet side with a substantially impermeable layer in order to force the second phase through the injection channels.

The device and method are particularly suitable for producing emulsions and foams. A particular embodiment of the method according to the invention has for this purpose the feature that the second fluid comprises a liquid, and the at least one first fluid is chosen from a group comprising liquids, gases, powders and combinations thereof.

In addition, the method according to the invention can also be applied for mono-dispersed atomization of a fluid. A further particular embodiment of the method according to the invention has for this purpose the feature that the second fluid comprises a gas and the at least one first fluid is chosen from a group comprising liquids, gases, powders and combinations thereof.

The invention also relates to an injection plate as applied in the above described device according to the invention and will be further elucidated on the basis of a number of exemplary embodiments and drawings.

DETAILED DESCRIPTION OF THE INVENTION

Figure 1:
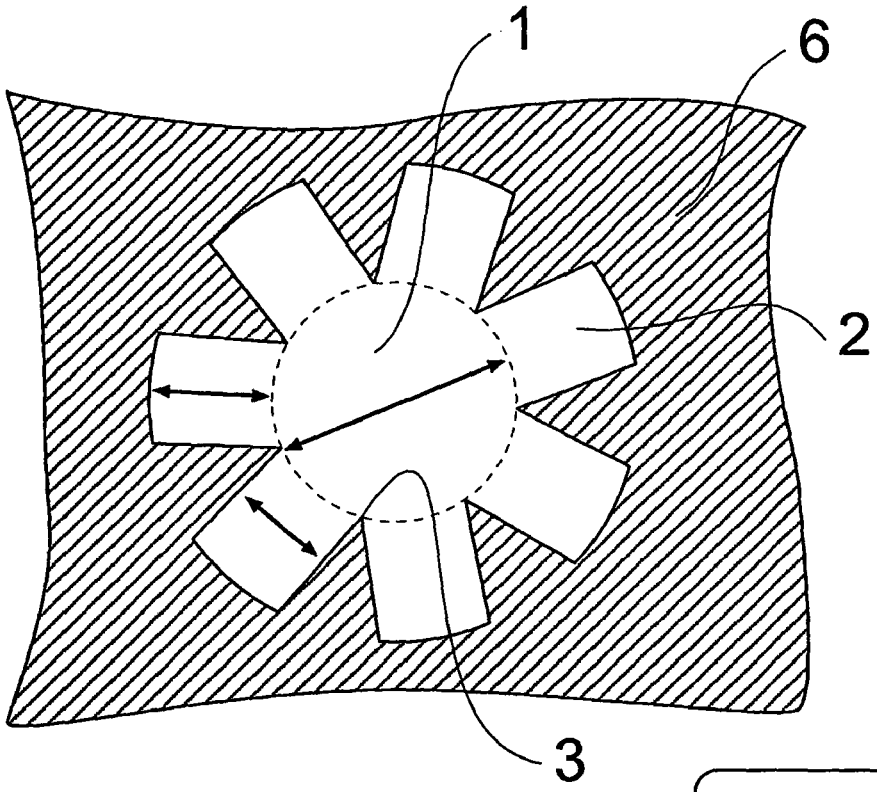
FIG. 1 shows a cross-sectional view of an embodiment of a device according to the invention.

FIG. 1 shows a cross-section of an embodiment of the device according to the invention based on an injection plate 6 according to the invention having therein an injection channel 1 and secondary channels 2 in the form of side extensions with a practically quadrangular cross-section. In this embodiment the injection channel is round but, within the scope of the invention, a different form can be chosen herefor, as also for the extensions 2, for instance a rectangle, a polygon, an ellipse, a circle, a star shape or a sequence of forms. With a careful dimensioning of the effective diameter of injection channel 1 relative to an effective diameter of extensions 2, a sufficiently high inflow resistance can be given to these latter to a fluid carried through the injection channel so as to enclose the fluid at least almost completely in injection channel 1. Different side extensions can be mutually connected so as to thus reduce a flow resistance of the assembly of secondary channels 2.

Figure 2:
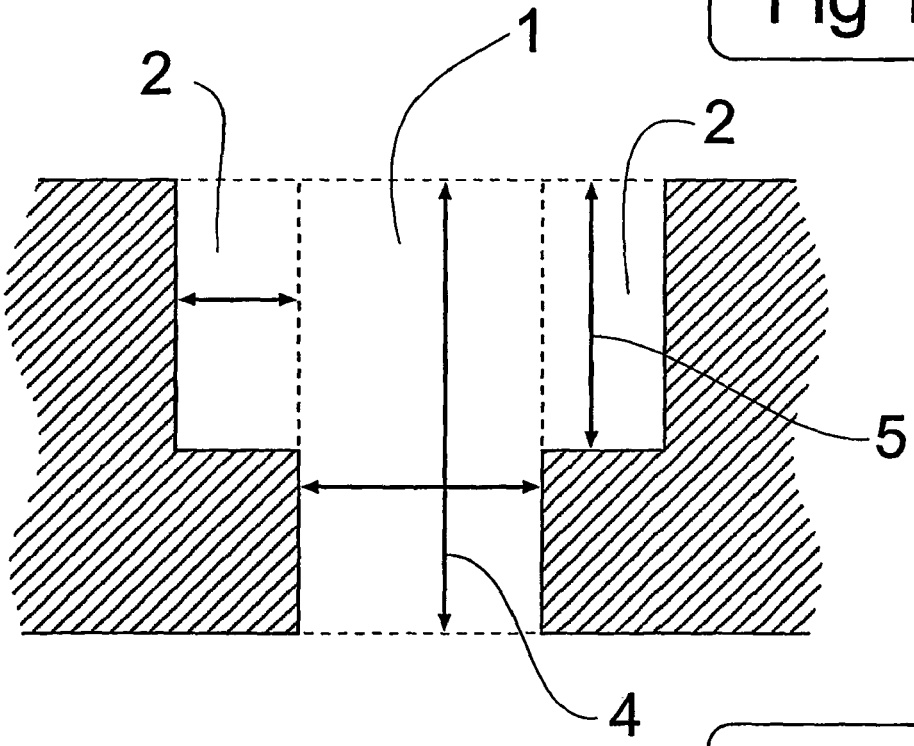
FIG. 2 shows a longitudinal section of the channel plate of FIG. 1.

FIG. 2 shows a longitudinal section of the channel plate of FIG. 1. Clearly shown is that in this embodiment a depth (length) 5 of the secondary channels 2 is chosen to be smaller than the depth (length) 4 of the injection channel. The depth of secondary channels 2 is less than half the depth of the injection channel, but extends at least as far as a (virtual) break-up point in injection channel 1 of a fluid being carried through the injection channel.

In this embodiment use is made for the injection plate of a substrate 6 of silicon with a thickness of about 75 micrometers which defines the channel length of the injection channel. A number of practically identical injection channels is arranged in the substrate by means of a photolithographic etching process, which allows a controlled and precise definition thereof. A part of the injection plate is shown in perspective view in FIG. 3, which also clearly shows that outflow openings 7 of the injection channels lie flush with the surrounding surface of substrate 6. Injection channels 1 have an effective diameter in the order of 10 micrometers, while an effective diameter of the side extensions 2 formed thereon amounts to about 3 micrometers. The side extensions are formed (etched) to a depth of about 40 micrometers in substrate 6.

Successive extensions 2 on channel 1 enclose between them a pointed wall part 3 of injection channel 1. These sharp points (structures) reduce the contact surface and thus enhance the break-up into a droplet or gas bubble of a fluid flowing through injection channel 1, and moreover prevents penetration of this fluid into secondary channels 2.

Figure 3:
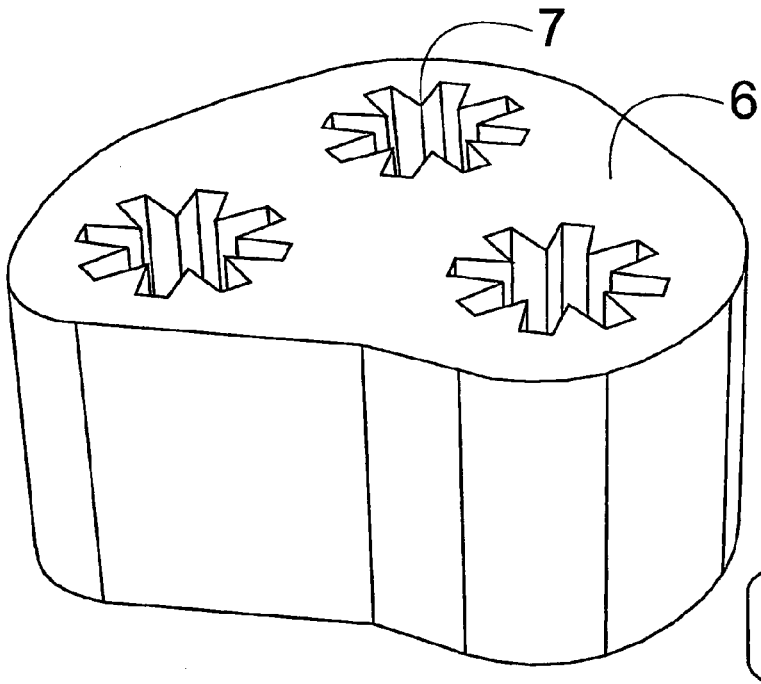
FIG. 3 shows a perspective view of part of the injection plate of FIG. 1.
Figure 4:
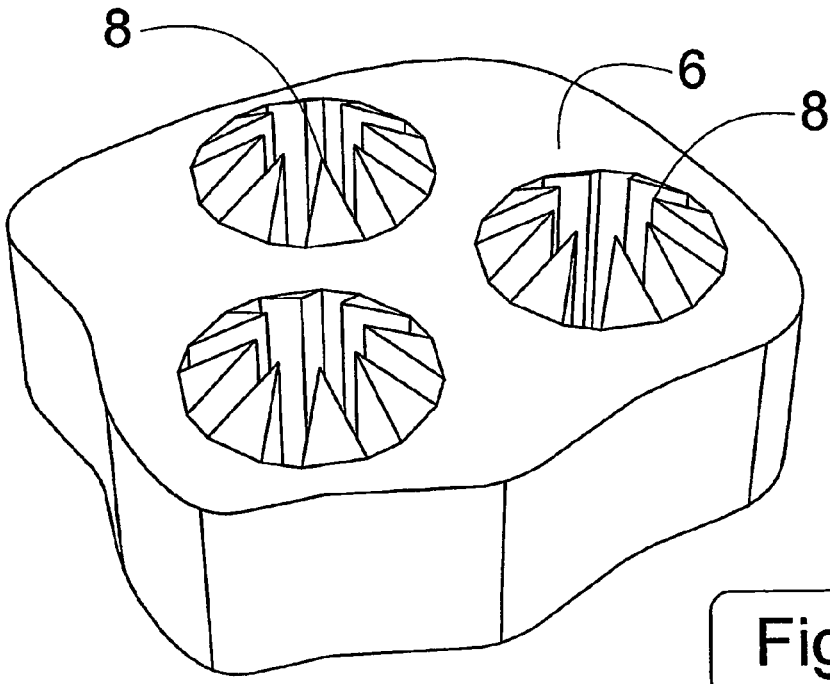
FIG. 4 shows a perspective view of an alternate embodiment of the injection plate of FIG. 3.

FIG. 4 shows a perspective view of an alternative embodiment of the injection plate of FIG. 3. In this embodiment the injection channels protrude with projecting wall parts 8, which bound side extensions formed thereon, above the surface of substrate 6 so as to prevent adhesion to the surface of a formed droplet or bubble.

Figure 5:
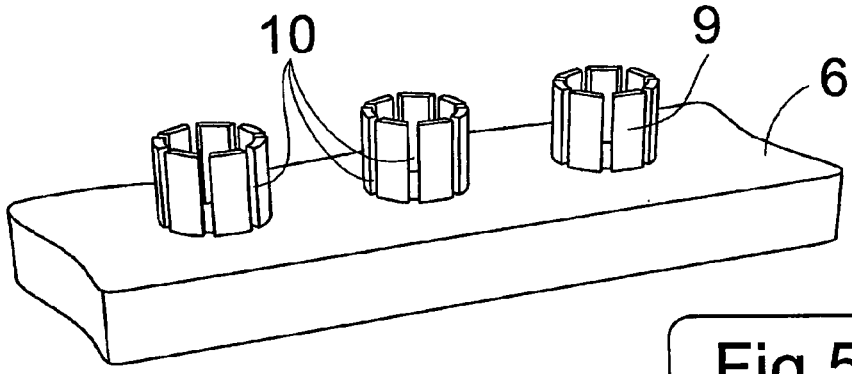
FIG. 5 shows a perspective view of a further embodiment of an injection plate of FIG. 1.

FIG. 5 shows a perspective view of a further embodiment of an injection plate wherein the injection channels project with their outer end above the surrounding surface of substrate 6. Formed here in the protruding parts are a number of secondary channels in the form of slots 10 which admit an auxiliary fluid into the injection channel in order to thereby induce an independent break-up at a break-up point of a fluid carried through the injection channel. This is shown schematically in the longitudinal section of FIG. 6. A length 14 of projection 9 is preferably in the order of a minimum of 1-5 times the effective radius of the injection channel in order to ensure that break-up takes place in the projection of the injection channel instead of deeper in the injection channel.

During operation a flow of first fluid is guided through injection channel 1 at a certain overpressure and leaves the injection channel on an outlet side of substrate 6 in the form of droplets formed from the first fluid. On the shown outlet side a flow of a second fluid is herein carried along the surface of substrate 6, the so-called cross-flow, into which the formed droplets are taken up. Foams and emulsions of mutually differing fluids can thus be manufactured on industrial scale.

Break-up of the first fluid flow in injection channel 1 takes place in that the second fluid can penetrate 11 into the injection channel via channel gaps 10 at a break-up point where the first fluid 13 will naturally want to break up. Because the second fluid enters the injection channel, the formed droplets or gas bubbles 12 will move out of the injection channel and break away.

Figure 6:
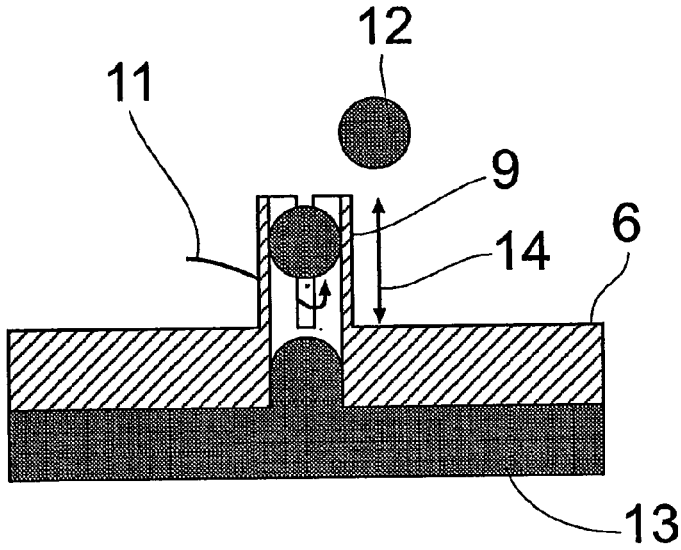
FIG. 6 schematically shows a longitudinal section of the injection plate of FIG. 5.
Figure 7:
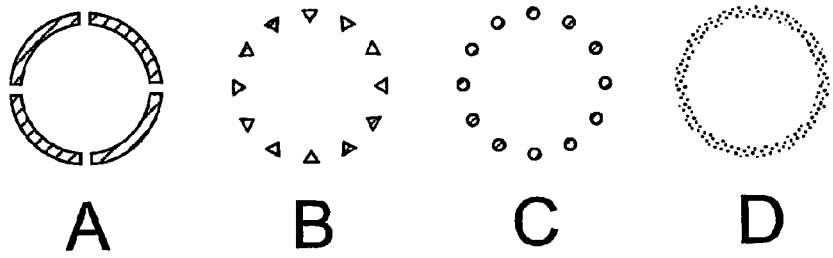
FIGS. 7A-D show in top view a number of alternative forms of an outer end of an injection channel such as in FIGS. 5 and 6.

FIGS. 7A-7D show in top view a number of alternative forms of an outer end of an injection channel 1 such as that in FIGS. 5 and 6. The protruding wall parts (segments) 9 preferably have a sharp point toward the centre of the injection channel (FIG. 7B). A preferred embodiment of an injection plate with an injection channel provided with secondary channels according to the invention makes use of a porous tube which protrudes above the surface (FIG. 7D) and which, due to an open pore structure in a wall thereof, forms a large number of secondary micro-channels from the outside to the inside. A number of such injection channels is preferably realized adjacently of each other by bundling a corresponding number of hollow fibres/tubes. The porous structure preferably extends into substrate 6.

Figure 8:
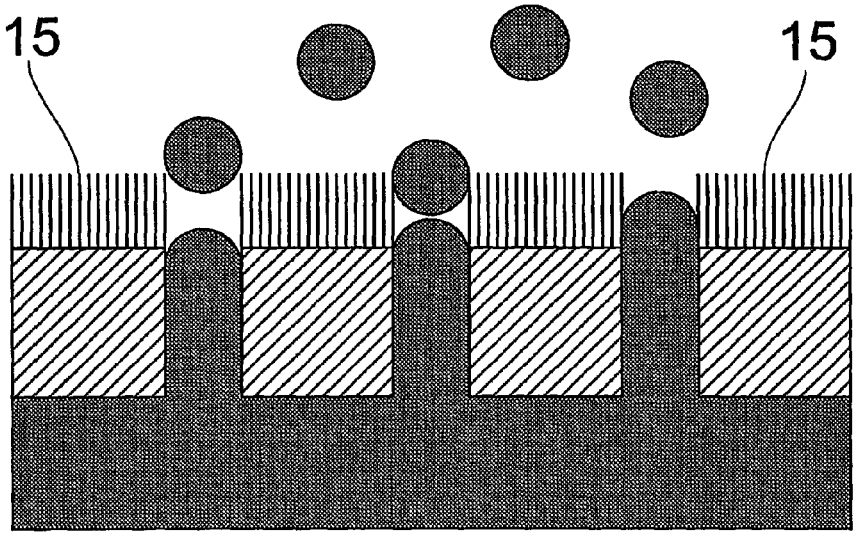
FIG. 8 shows a further embodiment of a device according to the invention.
Figure 9:
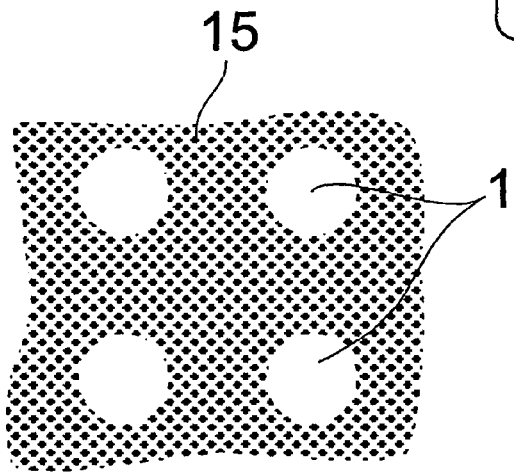
FIG. 9 shows a top view of the device of FIG. 8.

A further embodiment of a device according to the invention is shown in FIG. 8. Here pillars or nanotubes 15, preferably of carbon, are grown selectively on the surface of the substrate on a starting layer of for instance nickel. The upright pillars are preferably hydrophilic (for an aqueous second fluid), so that the second fluid can pass between the pillars to reach the injection channel, while the first fluid (in the case of an oily liquid or a gas) has no affinity therewith. Pillars 15 are moreover long enough that the second fluid arrives in the injection channel where the break-up must take place. The pillars or nanotubes are preferably grown with a Chemical Vapour Deposition process. FIG. 9 shows a top view of the device of FIG. 8.

Figure 10:
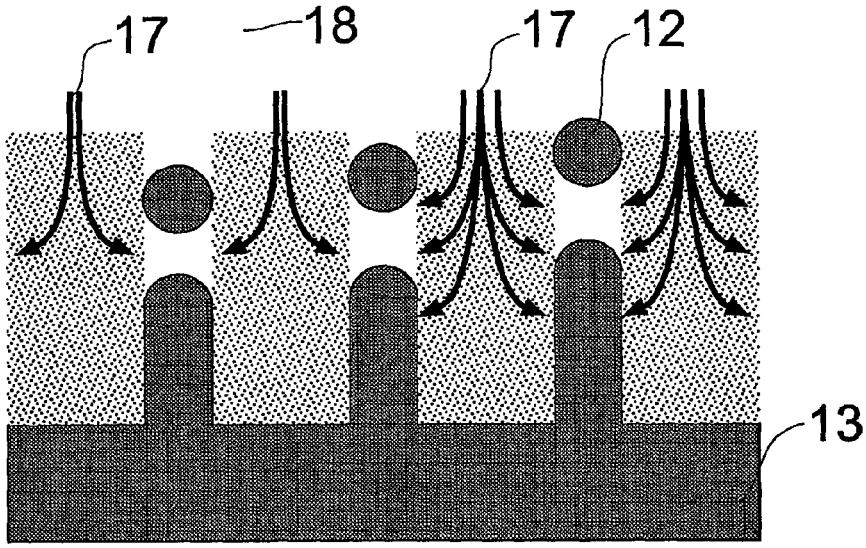
FIG. 10 shows a cross-section of a further embodiment of a device and channel plate according to the invention.

FIG. 10 shows a cross-section of a further embodiment of a device and channel plate according to the invention. In this case the injection channels are arranged in a completely porous substrate which has an open pore structure 16 which forms a number of secondary micro-channels toward the injection channels. The porous structure preferably has a high affinity (good wetting) with the second fluid 18 and no affinity (no wetting) with the first fluid 13. Long-term operation of the injection channel is hereby also guaranteed. The second fluid 17 can reach the injection channel through porous structure 16 and therein facilitate break-up of the first fluid 13 into droplets or gas bubbles 12. The injection channels can optionally be arranged over only a part of a thickness of the porous substrate, in which case a preceding substrate part can serve as filter.

Figure 11:
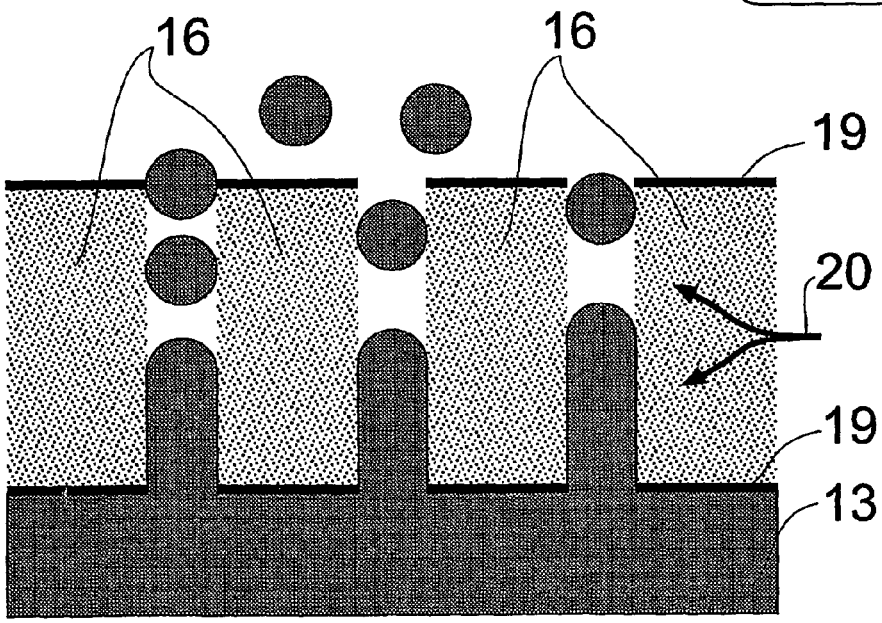
FIG. 11 shows a further embodiment of a device and injection plate according to the invention.

A further embodiment of the device and injection plate according to the invention is shown in cross-section in FIG. 11. Here too the secondary channels are formed as micro-channels in porous substrate structure 16. In this case however, porous structure 16 lies between a non-porous, or at least less porous, top layer and bottom layer 19, so that neither the first nor the second fluid can penetrate therein via a main surface. Instead the porous structure has a connection 20 for a separately supplied auxiliary fluid outside the injection channel for the purpose of thus guiding this auxiliary fluid actively into the porous structure under controlled pressure. A heating/dissipation of the second fluid via porous substrate structure 16 can hereby be prevented, and the break-up process can moreover be controlled more precisely. The top and bottom layers 19 in particular can have a differing porosity, or even be completely closed. This latter is particularly the case with the bottom layer, which then stops the first fluid being able to penetrate from below into porous structure 16.

Figure 12:
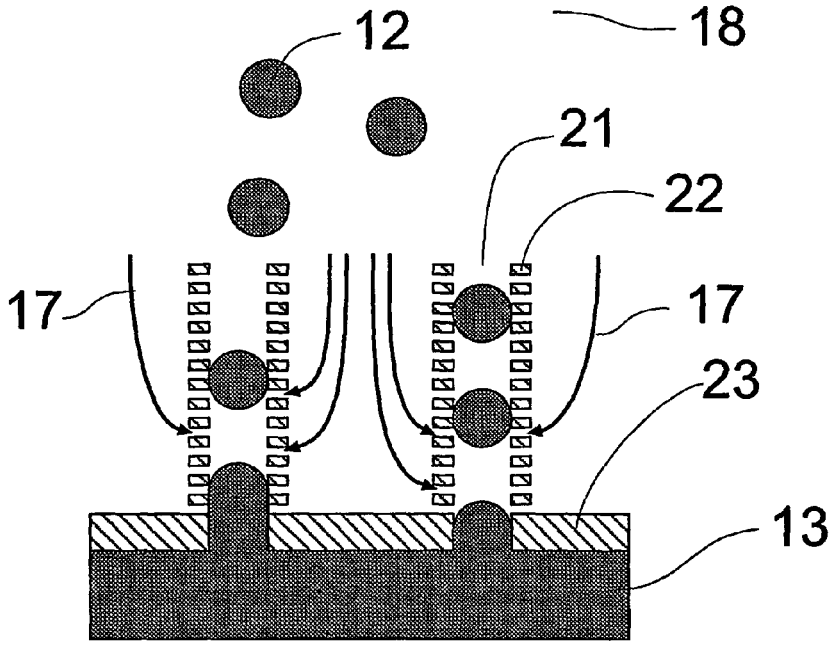
FIG. 12 shows a top view of a further embodiment of an injection plate and device according to the invention.
Figure 13:
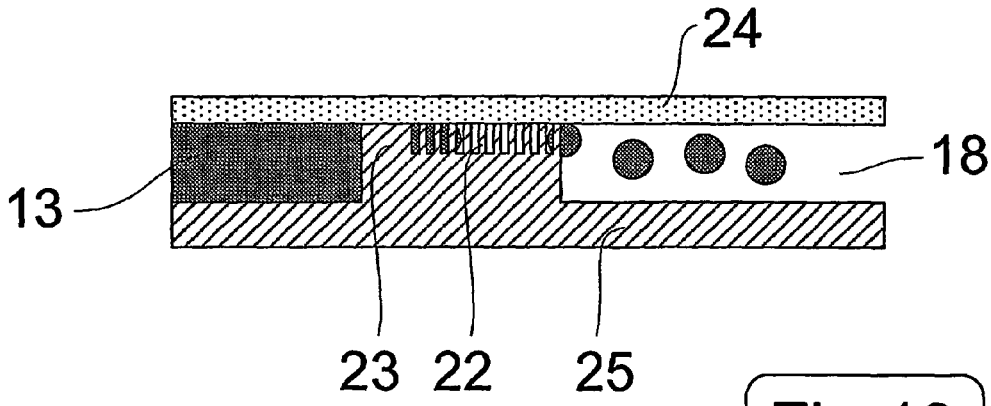
FIG. 13 shows a side view of a further embodiment of an injection plate and device according to the invention.

FIGS. 12 and 13 show a top and side view respectively of a further embodiment of an injection plate and device according to the invention. Here the injection channel 21 and the secondary channel are arranged preferably by means of etching in a flat plate 25 of silicon which is employed here as bottom plate of the device. Instead of etching, use can also be made in some cases of a moulding process to form the channel. The length of injection channel 21 can be set in simple manner by modifying the (etching) mask or the mould used. Secondary channels are here defined by small dams 22 which are preferably pointed, but which can also be round or rectangular. The second fluid can flow into the injection channel as auxiliary fluid through the openings between the small dams, this being shown schematically with an arrow 17. The first fluid 13 is separated from the second fluid 18 by a dam 23.

The channel structure of dam 23 and the secondary channels is closed with a preferably transparent top plate 24 so that the break-up process is visible through the top plate. In an alternative embodiment the bottom plate 25 and top plate 24 are flexible and can be rolled up. In another embodiment the top plate 24 is omitted and the flexible bottom plate 25 also forms a top plate after it has been rolled up. Small dams 22 are preferably made using a phase separation process. The small dams optionally have a porous structure, in which case they can take a connected form and intermediate spaces between the small dams are not necessary. The structure gains mechanical strength in this case. In yet another embodiment, a number of injection channels lie closely adjacent to each other and small dams 22 are made of porous material such that the separating dams 23 are unnecessary.

Figure 14:
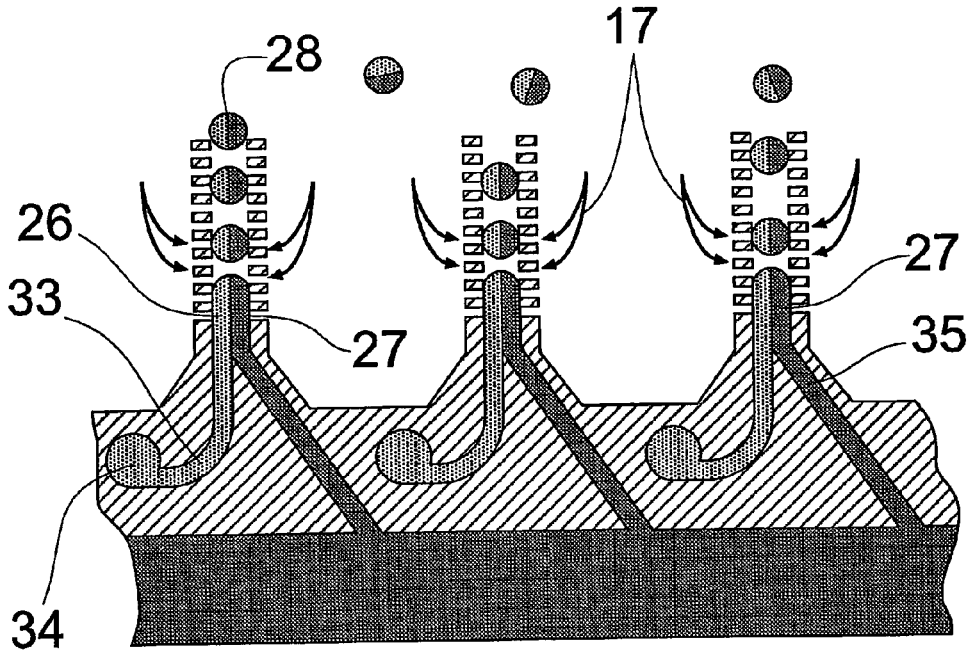
FIG. 14 shows a schematic top view of a further embodiment according to the invention.
Figure 15:
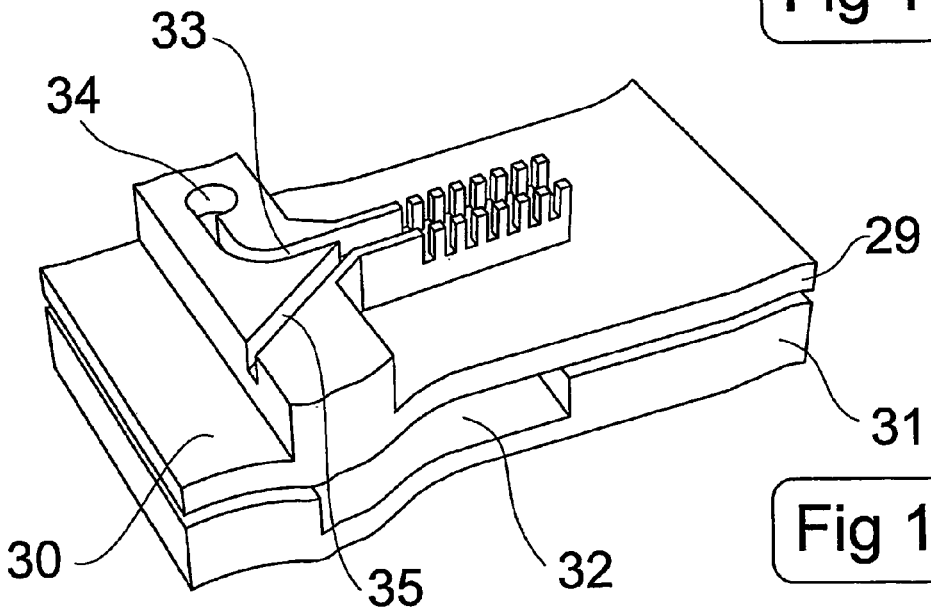
FIG. 15 shows a perspective view of a part of the device of FIG. 14.
Figure 17:
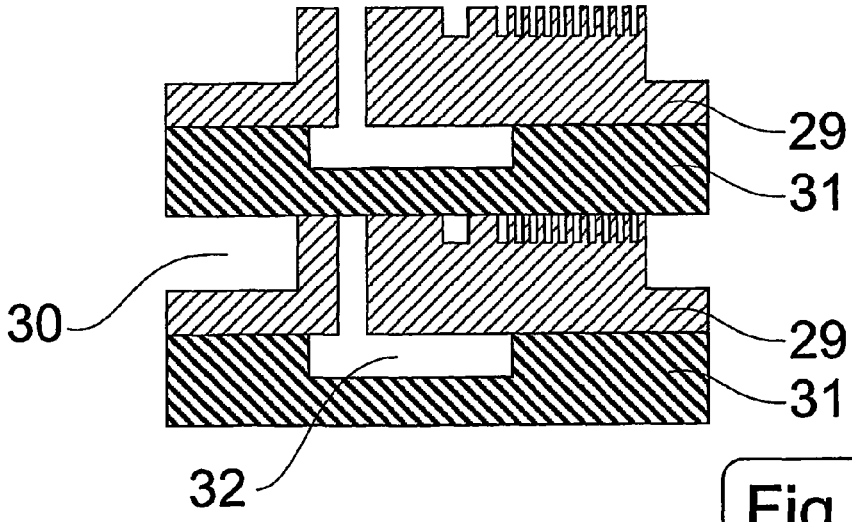
FIG. 17 shows a cross-section of stacked channel plates in an embodiment of a device according to the invention.

FIG. 14 shows a schematic top view of a further embodiment according to the invention with which two-colour microspheres 28 in particular can be made. Two flows 26, 27 of a first fluid come together in the injection channel from separate feed channels 33,35 and will break up into microspheres 28 using the inflow of the second fluid 17 as auxiliary fluid. The flow resistances and the lengths of the two feed channels 33,35 are preferably adapted to each other so that colour distribution in microsphere 28 is symmetrical. For a non-symmetrical colour distribution the channels 33,35 are accordingly adapted to each other proportionally. In addition to making microspheres of two colours, this embodiment is also suitable for other applications wherein two liquids must be brought together in small micro-capsules, such as for instance different components of a glue solution and/or of sensitive medication, which are thus enclosed directly so that they are not exposed to air. In FIG. 15 is drawn a perspective view of a part of the device of FIG. 14. Channel plates 29 and 31 are here mounted on each other, wherein a feed channel 32 can be placed in non-critical manner under a feed hole 34 for the one first fluid such that simple assembly is possible. Both channel plates 29 and 31 are preferably placed alternately one above the other so as to thus obtain a high density of injection channels. Such a stacking is shown in FIG. 17 and preferably takes place by rolling two channel plates together, these taking a flexible form for this purpose by being manufactured for instance from a multilayer polymer foil, in particular from a multilayer plastic substrate. Feed channels 30 and 32 for the two separate first fluids have large dimensions such that a flow resistance of these channels is significantly lower than that of feed channels 33 and 35 of each injection channel. In this manner a plurality of injection channels can be provided simultaneously from common sources with the first fluids.

Figure 16:
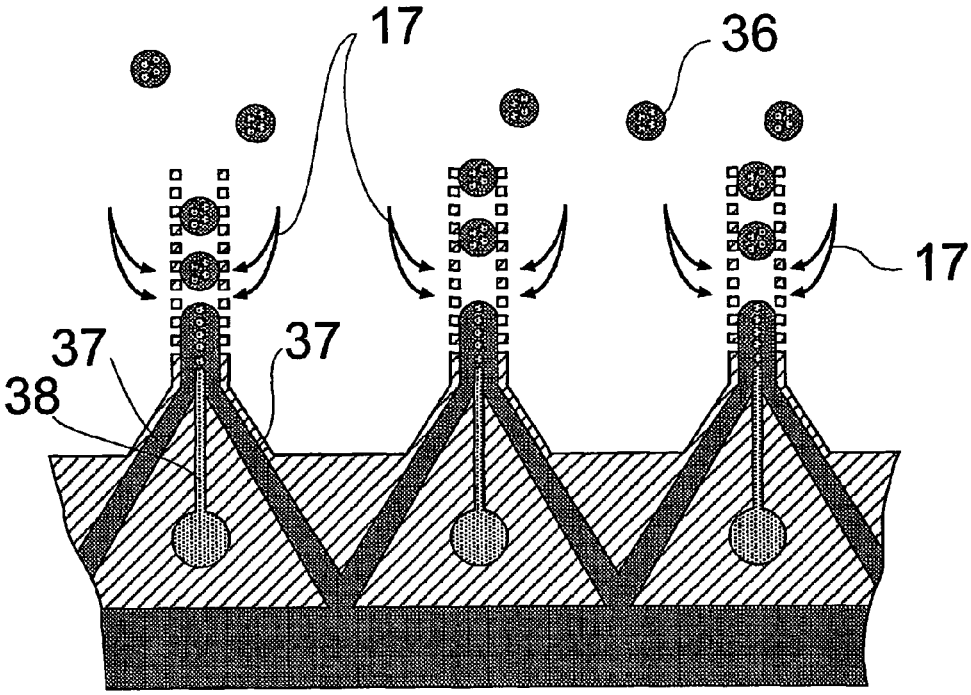
FIG. 16 shows a schematic top view of an alternative embodiment of the injection plate and device according to the invention.

In FIG. 16 is drawn a schematic top view of an alternative embodiment of the injection plate and device according to the invention with which double emulsions 36 can be made. Preferably guided through a channel 38 is a phase which is encapsulated in a second phase which is supplied symmetrically 37 round the first phase, whereafter this flow of two phases will break up into separate droplets 36 in that the second fluid can flow as auxiliary fluid via secondary channels into the injection channel.

FIG. 17 shows a cross-section of stacked channel plates in an embodiment of a device according to the invention. Channel plate 31 forms a cavity 32 for the supply of a first fluid as well as injection channel 30, wherein the injection channel is closed by the subsequent channel plate 31.

Figure 18:
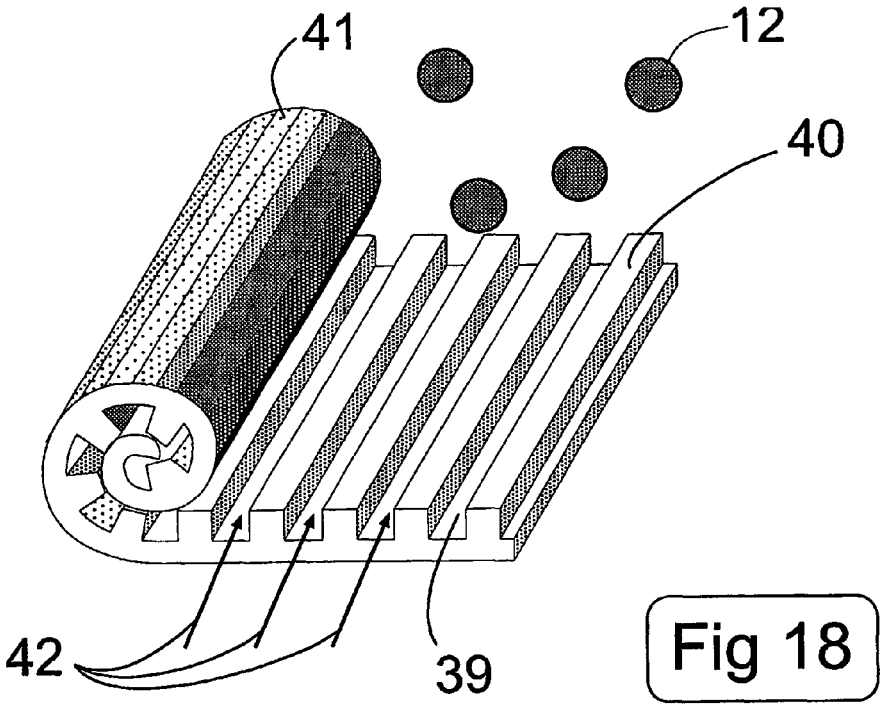
FIG. 18 schematically shows the rolling-up of the flexible porous layer of the device according to the invention.

FIG. 18 shows schematically the rolling-up of the flexible porous layer 40 structured with a line pattern 39, for instance for the purpose of obtaining the embodiment of FIG. 12. Due to the rolling-up a rear side 41 will close off the line pattern 39. The first fluid is preferably supplied on a feed side 42 and will then break up into droplets 12 in the injection channels defined by the line patterns. An auxiliary fluid can penetrate into the injection channels via the porous wall of the structure in order to facilitate this break-up.

Figure 19:
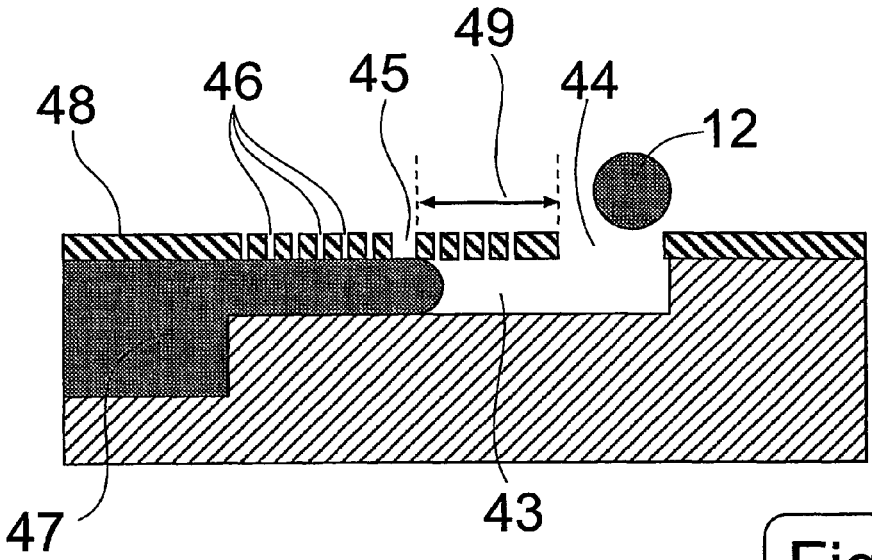
FIG. 19 schematically shows a further embodiment of the invention.
Figure 20:
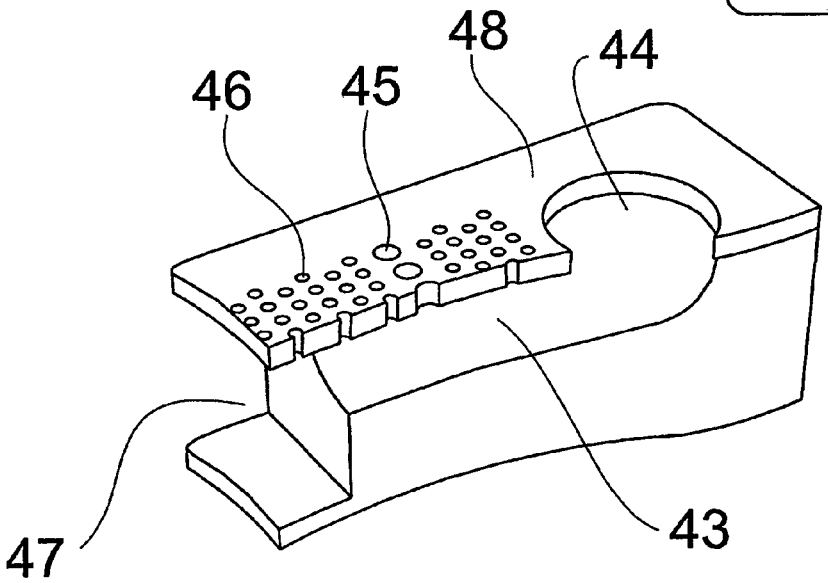
FIG. 20 shows a perspective cut-away view of the device of FIG. 19.

FIG. 19 shows schematically a further embodiment of the invention with an injection channel 43 and a secondary channel 45. Preferably etched into a silicon surface is a channel which defines the injection channel 43 and which is connected to a feed channel 47. The injection channel is preferably closed by a cover 48 in which, at a distance 49 from opening 44 of preferably 1-5 times the effective radius of injection channel 43, one or more openings 45 are made. The second fluid can penetrate as auxiliary fluid via this/these opening(s) 45 into the injection channel and will there facilitate the break-up of the first fluid. These openings are preferably smaller than the effective diameter of injection channel 43. Arranged in cover 48 are auxiliary openings 46 which are smaller than the inflow openings 45 for the auxiliary fluid, which can be used to etch the injection channel and can ensure that the auxiliary fluid wets the wall of the injection channel so as to give the wall little affinity with the first fluid. The injection channel is preferably covered with a coating, in particular a porous coating, which distributes the auxiliary fluid from openings 46 over the whole inner surface of injection channel 43 in order to optimize internal wetting of the injection channel. FIG. 20 shows a perspective cut-away view of the device of FIG. 19.

Figure 21:
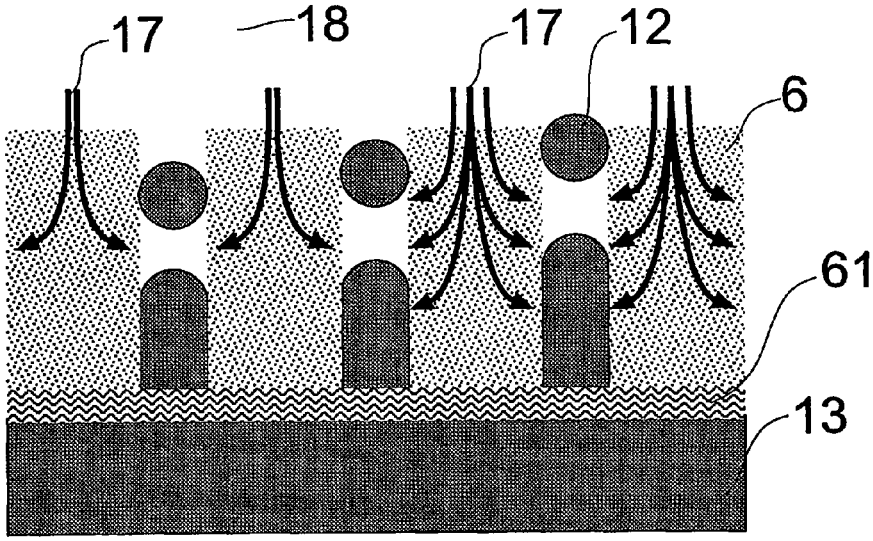
FIG. 21 shows a further embodiment of an injection plate and device according to the invention.

FIG. 21 shows a further embodiment of an injection plate and device according to the invention. In this case use is made of a fully porous substrate 6 in which are formed injection channels which extend over only a limited part of the thickness from an outlet side thereof. A porous base layer 61 thus comes before the injection channels which filters the first fluid 13 before it enters the injection channels. The second fluid 18 provides via the porous substrate structure a flow of an auxiliary fluid, indicated schematically with arrows 17, which via micro-channels formed through the porous structure finds its way to the injection channels and therein facilitates a break-up of the first channel into droplets 12 close to a break-up point. If desired, the flow resistance of the auxiliary fluid in such a porous structure can be reduced by forming therein from an inflow side recesses or other macroscopic accesses which extend over a part of the path as far as the injection channel wall and in which the auxiliary fluid encounters only a very limited flow resistance.

Although the invention has been further elucidated above on the basis of a number of exemplary embodiments, it will be apparent that the invention is by no means limited thereto. On the contrary, many variations and embodiments are still possible within the scope of the invention for the person with ordinary skill in the art. Such variations and embodiments are for instance:

An injection plate, wherein the injection channel has a length (depth) greater than the length (depth) of the at least one secondary channel. The inflow of the first fluid into the at least one secondary channel is hereby prevented.

A particular embodiment is stacking/rolling-up of a structured porous layer, preferably a layer with a line pattern. Possibly in combination with optionally structured layers of other materials.

A particular embodiment is an injection plate with a number of injection channels, wherein the outflow openings of adjacent injection channels are placed close to each other such that adjacent droplets 'feel' each other. For a droplet from a central injection channel the simultaneously generated droplets from the adjacent injection channels form as it were a boundary wall of a thus dynamically formed further injection channel, wherein a secondary channel is inherently present between the different droplets, whereby the unstable droplets can break off.

The invention is not limited to injection channels and secondary channels with the same cross-section along their whole length. Variations therein along the channel length, such as for instance tapering, can on the contrary have a positive effect on manufacturing capability and/or functioning.

Instead of one or several injection channels, the device according to the invention can also be embodied with a large number of injection channels integrated for this purpose in one or more shared substrates. An injection plate can thus be realized with more than a thousand injection channels ordered adjacently of and parallel to each other in a two-dimensional matrix or in other manner, with a mutual pitch of less than ten times, and preferably less than five times, the effective diameter of a channel.

An initial diameter of an injection channel can if desired be made smaller by applying an additional layer to an inner wall thereof, for instance by a uniform deposition of an appropriate material from a damp phase (CVD).

The first fluid can of course optionally be provided to the injection channel in a number of different liquid flows, or the first fluid can consist of a number of phases in order to make for instance encapsulated emulsions or to obtain multiple components in a droplet or a gas bubble, such as for instance double emulsions.

The emulsions manufactured with the invention are highly suitable for obtaining mono-dispersed microspheres. Diverse methods known from the literature can herein be employed to cure the dispersed droplets and give them the desired texture.

Self-break-up in the injection channel occurs by applying the specific pressure gradient inside the injection channel. The required pressure gradient can be applied in many ways, for instance by providing a periodic pressure profile on the feed side, wherein at each pressure pulse one or more droplets are pressed through and broken off. An accurate setting of the break-up frequency of the droplets and the pressure profile control frequency are important here. Measures can also be taken on the injection plate, for instance by incorporating active and/or passive valve constructions or by applying elastic materials.

A great advantage of the invention is that injection plates with a greater porosity can be used than in conventional cross-flow applications, because the formed particles are 5-10 times smaller compared thereto. The chance of coalescence of adjacent droplets is hereby considerably smaller.

The injection plate can be manufactured using different technologies and techniques. This is possible for instance using Micro System Technology, phase separation technology on moulds, laser drilling, hot embossing, electroforming, and mechanical perforation, this not being an exhaustive list. Use can also be made of photosensitive polyimide or SU-8.

The device and method according to the invention can be utilized for industrial production of emulsions, foams and microspheres for, among others, food (or similar), pharmaceutical, cosmetic and chemical applications. This relates for instance to the production of soft and readily spreadable cosmetic products, general lubricants for reduced friction, food supplements, time-release medicines, encapsulated medicines, medical contrast liquids, glues, self-healing concrete, spacer microspheres, magnetic particles, polystyrene microspheres, single and double colour functional particles in E-ink, functional inks, toners, fluorescent particles, as well as for liquid crystal (LCD) applications. For additives in paints and coatings the invention can be applied for the purpose of improved corrosion properties, improved coverage, improved optical properties, improved wear, improved filling properties, reduced viscosity etc. The device and method according to the invention are also suitable for mono-dispersed foams, emulsions and double emulsions for food products, including dairy products such as cream and mayonnaise and low-fat milk, and for the manufacture of fruit drinks and further for homogenization of pre-emulsions (e.g. fat particles in milk) and for the many spray-drying applications. Mono-dispersed polymer, ceramic or metallic micro-particles can also be applied for, among others, optimized heat and mass transport, optimal charging, filling with functional materials, higher selectivity, improved stability etc. Finally, the surface properties of materials and substrates can be improved and modified with microspheres formed by the device and method according to the invention.

The invention claimed is:

1. A device for generating micro-spheres (12) from a fluid (13), comprising:

an injection plate (6) comprising at least one defined injection channel (1) having, on an inlet side, an inflow opening for receiving a flow of said fluid and, on an outlet side, an outflow opening (7) for delivering microspheres (12) formed from said fluid, and feed means provided for said injection channel, said feed means for carrying said flow of said fluid through the injection channel, the injection plate further comprising at least one secondary channel (2,10) which is intended and adapted to contain, at least during operation, an auxiliary fluid, wherein, at a first end, said at least one secondary channel (2,10) has an inlet to receive said auxiliary fluid, which inlet is in open communication with said outflow opening of said injection channel, wherein said at least one secondary channel (2, 10) has at least one second end in open communication with said injection channel at a side wall of said injection channel to deliver said auxiliary fluid to contact said fluid flow at the side wall of the injection channel to create a break-up point where, at least during operation, said flow of said fluid breaks up into separate parts, and, wherein for at least a part of said flow of said fluid, an inflow resistance of the secondary channel is greater than an inflow resistance of the injection channel.

2. The device as claimed in claim 1, wherein the injection plate (6) and the inlet side bound a first space, which first space is intended and adapted to receive therein at least one first fluid at least during operation, and the injection plate and the outlet side bound a second space, which second space is intended and adapted to receive therein at least one second fluid at least during operation.

3. The device as claimed in claim 1, wherein the secondary channel (2,10) extends, at least during operation, in open communication from a surface of the injection plate (6), in particular from the outlet side thereof.

4. The device as claimed in claim 1, wherein the secondary channel is a laterally bounded side extension (2) of the injection channel (1) which extends from the outlet side of the injection plate to at least the break-up point of the injection channel.

5. The device as claimed in claim 1, wherein the side extension (2) has an incomplete, at least substantially round or polygonal cross-section transversely of a flow direction of the injection channel.

6. The device as claimed in claim 1, wherein the injection channel (1) has a number of laterally bounded side extensions (2) which extend from the outflow opening to at least the break-up point, and neighbouring extensions are immediately adjacent of each other and herein mutually enclose a pointed wall part (3) of the injection channel.

7. The device as claimed in claim 1, wherein at least at the position of the break-up point a wall of the injection channel (1) is porous with an open pore structure (16), which open pore structure forms the at least one secondary channel.

8. Device as claimed in claim 7, wherein the injection plate (6) comprises at least a top layer (16) with an open pore structure from the outlet side at least as far as the break-up point in the injection channel (1), which open pore structure forms the at least one secondary channel.

9. Device as claimed in claim 8, wherein the injection plate (6) comprises a number of individual injection channels (1) which are accommodated in separated parts of the top layer of the injection plate, at least for the auxiliary fluid.

10. The device as claimed in claim 1, wherein the injection plate (6) comprises a projection (9, 10) on the outlet side around the outflow opening of the injection channel.

11. Device as claimed in claim 10, wherein the projection (9) of the injection plate at least partially comprises the at least one secondary channel (10).

12. Device as claimed in claim 10, wherein the at least one secondary channel comprises at least one perforation or slot (10) in a wall of the projection (9).

13. The device as claimed in claim 1, wherein the injection channel (1) has a length which amounts to a minimum of about twice a distance between the outflow opening and the break-up point.

14. The device as claimed in claim 1, wherein the break-up point lies at a distance removed from the outflow opening of one to five times an effective radius of the injection channel (1).

15. The device as claimed in claim 1, wherein the at least one secondary channel (2) per injection channel (1) is chosen in number and area such that up to the break-up point in respect of the auxiliary fluid a total flow resistance of the secondary channel is smaller than ten times a flow resistance of the injection channel from the break-up point in respect of the first fluid.

16. The device as claimed in claim 1, wherein an effective diameter of the secondary channel (2) is smaller than an effective diameter of the injection channel (1) and is a minimum of twice as small.

17. The device as claimed in claim 1, wherein the injection channel (1), in combination with the injection plate (6), has a nano-rough or micro-rough surface structure.

18. The device as claimed in claim 1, wherein the injection plate has, at least in a wall part around the injection channel, a microporous structure with a very low flow resistance to the auxiliary fluid.

19. The device as claimed in claim 1, wherein the injection channel (1) extends substantially laterally in the injection plate (6), the at least one secondary channel (2) opens onto a free surface part of the injection plate with at least one perforation of a first dimension, and the injection channel debouches on the outlet side of the injection plate into at least one perforation of a second larger dimension.

20. The device as claimed in claim 1, wherein, at least during operation, the inflow opening of the injection channel (1) is in open communication with separate inlets for different fluids.

* * * * *